United States Patent [19]

Kenderi

[11] Patent Number: 4,871,114

[45] Date of Patent: Oct. 3, 1989

[54] APPARATUS FOR POWER SPRAYING OPERATING WITH FLAME JET

[76] Inventor: Tibor Kenderi, Kelenhegyi u. 49., 1118 Budapest, Hungary

[21] Appl. No.: 262,158

[22] Filed: Oct. 19, 1988

Related U.S. Application Data

[63] Continuation of Ser. No. 929,029, Sep. 29, 1986, abandoned.

[51] Int. Cl.[4] ..... B05B 9/06; B05B 1/24; B05B 1/26

[52] U.S. Cl. ..... 239/79; 239/129; 239/424.5; 239/498

[58] Field of Search ..... 239/79, 424.5, 498, 239/128, 129, 132

[56] References Cited

U.S. PATENT DOCUMENTS

| | | | |
|---|---|---|---|
| 2,840,152 | 6/1958 | Reed | 239/498 |
| 4,192,460 | 3/1980 | Matsuo | 239/79 |
| 4,541,796 | 9/1985 | Anderson | 239/424.5 X |
| 4,616,779 | 10/1986 | Serrano | 239/79 |

FOREIGN PATENT DOCUMENTS 159923 7/1972 Hungary .

*Primary Examiner*—Andres Kashnikow
*Assistant Examiner*—Patrick N. Burkhart
*Attorney, Agent, or Firm*—Handal & Morofsky

[57] ABSTRACT

Apparatus for powder spraying operated with a flame jet having a spray head for feeding the powder carried by a gas into a combustion space, a pipe for supplying a combustible gas to the spray head, a spray head body having rows of bores formed therein for emitting and guiding the combustible gas to the combustion space for forming a flame jet mixture with the powder, a plurality of sideplates and endplates extending over the spray head body on the side facing the combustion space, the combustion space includes teeth of comb-type extensions confining the combustion space, the teeth being fixed in a heat conducting manner to a side member lying perpendicularly to a surface of the spray head.

15 Claims, 1 Drawing Sheet

APPARATUS FOR POWER SPRAYING OPERATING WITH FLAME JET

This application is a continuation of application Ser. No. 929,029, filed Sept. 29, 1986, now abandoned.

CROSS REFERENCE TO RELATED APPLICATION

This application is a continuation of co-pending International Patent application PCT/HU 86/00006.

TECHNICAL FIELD

The invention relates to a sprayer operating with a flame jet, by the aid of which different powder metals can be melt and applied as a coating on a properly prepared surface. The apparatus has a spray head for feeding the powder delivered by a carrying substance, e.g. air, into the flame jet; in the body of the spray head bore-rows are to be found for emitting and guiding the mixture of combustible gas to the combustion space of the flame.

BACKGROUND ART

Applying powders in a melt state onto surfaces—in particular metal surfaces—represents a well known method. So e.g. the HU-PS 159 923 discloses a method of this type for applying and preparing a coating. In course of said method the flame required for melting is produced by using a mixture of acetylene and oxygen or acetylene and air. Powder—e.g. aluminium powder—is blown by means of pressurized air along a plane between two slabshaped flames tending to each other and melt inbetween, thereafter the melt powder is applied onto the surface to be coated by using pressurized air.

The disadvantage of said method and apparatus, respectively, lies in that acetylene is most expensive, energy exploitation is uneconomical, in addition, quality of coating obtained by the method and apparatus does not meet requirements.

A process and an apparatus are also known which use PB-gas or natural gas as combustible gas. The disadvantage of this solution lies in that in order to prevent lateral deflection of the powder jet discharged in a slab-shape from the spraying head and thus to eliminate powder losses, slab-shaped cold air-jets are directed onto the powder jet. In order to prevent powder losses to the desired extent, a considerable quantity of cold air is required decreasing considerably the temperature of the flame needed for melting the powder, resulting in a lower efficiency of powder melting. As a consequence of the significant quantity of cold air energy required for melting increases considerably, stability of the melting flame decreases. Flame stability is further deteriorated by the fact that structural design of the spray head of known apparatuses does not exclude arrival of the air streams coming from different lateral directions and of uncontrollable intensity at the melting flame.

DISCLOSURE OF INVENTION

The task of the invention is to develop a powder sprayer operating with a flame jet, with which the flame for melting the powders wanted to be melted and applied can be easily produced and maintained, in addition, energy content of the required combustible gas—compared to known solutions—can be exploited in a far better procentual ratio, geometric shape and dimensions of the flame are constant and ideal, accordingly shape and dimensions of the powder jet can be also ideally selected; the production costs of the apparatus are low, structural design is simple, at the same time required maintenance is minimal.

In accordance with the invention the task set is solved by providing a powder sprayer operating with a flame jet, having a spray head feeding the powder delivered by a carrying substance, e.g. air, into the flame jet, in the body of the spray head rows of bores are to be found emitting and guiding the mixture of combustible gases to the combustion space of the flame. The apparatus according to the invention can be characterized in that unilaterally and/or multilaterally arranged sideplates and/or endplates extending over the sprayer head body on the side facing the flame combustion space, formed similarly as teeth of $\epsilon$ comb and confining the flame space, are fixed—preferably welded—in a heat-conductive manner to the side lying practically perpendicularly to the surface of the sprayer head body, which incorporates the row of bores emitting the combustible gas needed for flame maintenance.

With the apparatus according to the invention it is considered as advantageous, if between the end of the pipe introducing the combustible gas and discharging into the spray head body and the bores of the rows of bores emitting the combustible gas, a system of passages is formed, allowing the flow of the combustible gas in the inside of the spray head body along a closed path, for an angle of at least 360°.

In the spray head body, the system of bores leading the combustible gas to bores of the row of bores consists essentially of bore-tracts interconnected orthogonally.

One or more sideplates and/or endplates can be made of a heat-proof material, so e.g. chrome steel, the outer surface of which can be optionally coated with thermal insulation.

With a preferred embodiment of the invention the part of the sideplate and/or endplate extending over the spray head body toward the combustion space is bent outwards from the plane of the side surface of the spray head body.

BRIEF DESCRIPTION OF DRAWINGS

The powder spraying apparatus operating with a flame jet according to the invention will be described in details by the way of examples illustrated in the accompanying drawings wherein.

BEST MODE OF CARRYING OUT THE INVENTION

Figure 1:
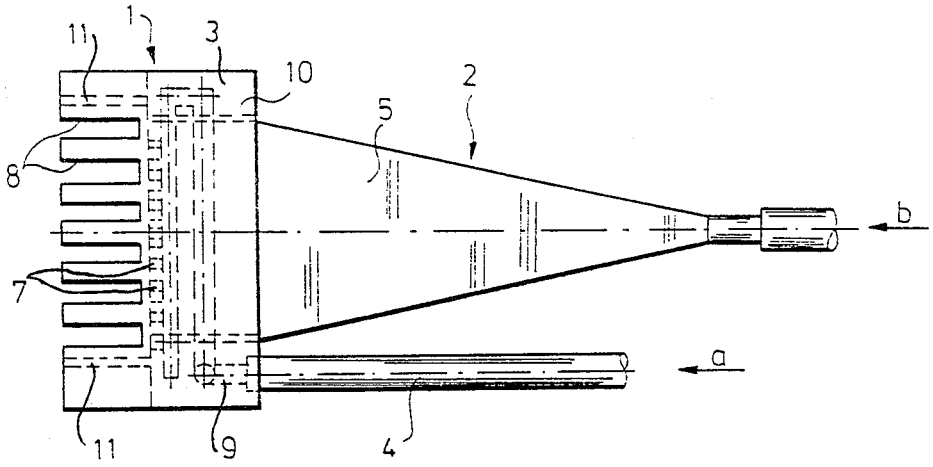
FIG. 1 shows the schematical side-view of a preferred embodiment of the apparatus according to the invention.
Figure 2:
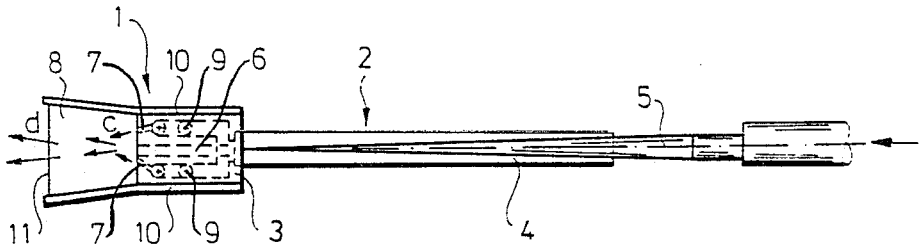
FIG. 2 shows the schematical top-view of the apparatus according to FIG. 1.
Figure 3:
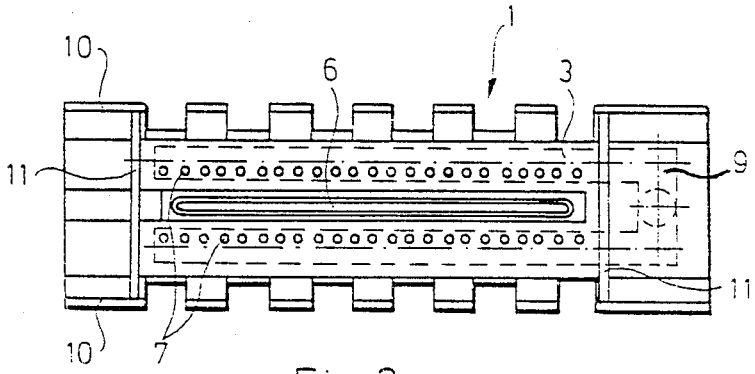
FIG. 3 shows the frontal view of the apparatus in enlarged scale.

The apparatus consists of two main parts, the spray head 1 and the pipeline-system 2 leading the combustible gas and the powder, as well as air or oxygen needed for combustion to the spray head 1.

The spray head body 3 of the spray head 1 can be prepared—in a well known manner—of a material of good thermal conductivity, e.g. bronze. The pipe 4 leading the combustible gas into the body of the spray head 3, as well as the nozzle pipe 5 of flattened shape and having a tapered cross-section, carrying the powdered material, e.g. aluminium powder intended to melt and to apply on a given surface, are connected in a sealed manner to the back-side of the spray head body 3. Pressurized air is streaming through the nozzle pipe 5 towards the spray head body 3, which is partly delivering the powder to be melt, partly it delivers a part of the oxygen needed for the combustion of the combustible gas.

As a continuation of the nozzle pipe 5, in the spray head body 3 the narrow groove 6 is formed, extending nearly in full length of the spray head body 3, on both sides of which—in a manner known per se—a row 7 of bores consisting of bores arranged side-by-side, is formed. The bores of the rows 7 of bores are arranged so, as to be convergent to the flame space 8 in front of the spray head body 3, while the axes thereof are intersecting in the middle-plane, in the symmetry-plane of the groove 6.

Inside the spray head body 3, between the discharge opening of the pipe 4 and the bores of the rows 7 of bores there is a bore system 9 interconnecting said bores, while the system consists of bore-tracts connected essentially orthogonally. Separate bore-tracts are leading from the discharge opening of the pipe 4 to the single rows 7 of bores.

The system 9 of bores allows to flow the combustible gas into the rows of bores, when pressurized air and powder are flowing to the groove 6 and therethrough to the flame space 8.

On both sides of the spray head body 3 running parallel with the rows 7 of bores a heat-conductive sideplate 10 each—preferably made of chrome-nickel steel—is fixed, e.g. welded, in a dissipation heat transferring manner. The spray head body 3 and the sideplates 10 are bearing up against one another on a large surface, consequently, efficiency of dissipation heat transfer between them is good. The part of the sideplates 10 extending over the frontal surface of the spray head body 3 incorporating the rows 7 of bores is formed similarly, as the teeth of a comb. This comb-teeth-like parts confine the flame space 8, accordingly the space, into which the combustible gas is discharged from the bores of the rows 7 of bores, as indicated by the arrows "c". Here the flame melts the pulverized material arriving together with the pressurized air from the groove 6, therefrom the melt powder is transported by the pressurized air and combustion products—as indicated by the arrows "d"—to the surface, which is intended to coat with the melt powder.

In dependence of the quality of the applied pulverized material and operative circumstances of coating it may happen that oxygen content of pressurized air delivering the powder through the nozzle pipe 5 and the groove 6 to the combustion space 8 does not suffice for proper burning to the combustible gas. In this case, through the slots of the comb-teeth-like shaped part of the side-plates 10 the required air excess can get unhindered into the combustion space 8, at the same time the teeth of the comb-teeth-like formed part of the sideplates hinders the laterally incoming air streams in disturbing stability of the flame. To increase stability, at both ends of the spray head body 3, between the sideplates 10 an endplate is also inserted, in such a manner the combustion space 8 becomes essentially closed, it is open only in direction of the surface to be coated.

As a consequence of the closed formation of the flame space 8 the parts of the sideplates 10 and endplates 11 enclosing the flame space 8 are considerably heated and a significant part of the heat is transferred to the spray head body 3, accordingly, the spray head body 3 becomes also hot, and the combustible gas arriving through the pipe 4 will be also considerably heated in the bore-system 9, so the heated gas is streaming through the bores of the rows 7 of bores into the flame space 8, where it is mixed with air and burnt.

It goes without saying that the flame of the combustible gas arriving at the flame space 8 in a heated state is far more stable and richer in calorie, as if the combustible gas arrived in a cold state into the flame space 8. In course of our experimental tests is could be observed that with the apparatus according to the invention for powder spraying, operated with a flame jet, when a mixture of PB-gas and air was used, when ignited, the flame burnt somewhat uncertainly. As soon as the temperature of the whole apparatus and so the temperature of the mixture of combustible gas allowed to flow through the spray head body 3 reached the value of 80° C., the flame became apparently more defined. If after some minutes—reckoned from the time of ignition—the mixture of combustible gas reached the temperature of 200° to 250° C., the flame resisted excellently to ambient air streams and took up a compact stable spatial form, never seen before.

In course of our experiments we could also observe that on effect of the heated side-plates 10 and endplates 11 the effect of the lateral external air streams was reduced almost to zero, even, if the spray head 1 was moved suddenly, with a quick motion laterally.

Summing up what has been said, the most advantageous features of the apparatus for powder spraying, operating with a flame jet are, as follows:

Applying of the powder coating to the selected surface can be performed relatively quickly and always in an excellent quality. Energy content of the combustible gas having been consumed for preparing the coating is practically without any losses, or at least it can be utilized with a minimal loss. Process of coat formation can be performed easily, without any difficulty, as temperature and shape, geometric form of the flame melting the powder are always constant, temperature is considerably higher, than with flames attainable under similar operative prerequisites. In addition, the apparatus can be cheaply manufactured, manipulation is simple, maintenance is hardly required.

I claim:

1. Apparatus for powder spraying operated with a flame jet, comprising a spray head for feeding the powder carried by a gas into a combustion space, pipe means for supplying a combustible gas to said spray head, a spray head body having rows of bores formed therein for emitting and guiding the combustible gas to the combustion space for forming a flame jet mixture with said powder, a plurality of sideplates and endplates extending over the spray head body on the side facing the combustion space, said plurality of endplates and sideplates being made of a heat-resistant material, the outer surfaces of said endplates and sideplates being coated with a thermal insulating layer of material, said combustion space includes teeth of comb-type extensions confining the combustion space, said teeth being fixed in a heat conducting manner to a side member lying perpendicularly to a surface of the spray head, wherein between a discharge end of the pipe means introducing the combustible gas and discharging into the spray head body and the rows of bores emitting the combustible gas into said combustion space, a plurality of passages are formed, allowing the combustible gas to flow within the spray head body along a closed path extending for an angle of at least 360°.

2. Apparatus for powder spraying operated with a flame jet,comprising a spray head for feeding the powder carrier by a gas into a combustion space,pipe means for supplying a combustible gas to said spray head, a spray head body having rows of bores formed therein for emitting and guiding the combustible gas to the combustion space for forming a flame jet mixture with said powder,a plurality of side plates and endplates extending over the spray head body on the side facing the combustion space,said combustion space includes teeth of comb-type extensions confining the combustion space,said teeth being fixed in a heat conducting manner to a side member lying perpendicularly to a surface of the spray head.

3. Apparatus as claimed in claim 2, wherein said passages leading the combustible gas to the row of bores in the spray head body consists essentially of bore tracts interconnected orthogonally.

4. Apparatus as claimed in claim 2, wherein said plurality of sideplates and endplates are made of a heat-resistant material, the outer surface of which is coated with a thermal insulating layer.

5. Apparatus as claimed in claim 2, wherein the part of the sideplate and endplate extending over the spray head body toward the combustion space is bent outward from the plane of the side surface of the spray head body.

6. Apparatus for powder spraying operated with a flame jet comprising:

(a) a spray head with a frontal face for feeding a powder in a carrier gas and a combustible gas to a combustion space;
(b) a plurality of side plates and end plates extending from the spray head in a manner such that said combustion space is enclosed within the perimeter defined by said side and end plates;
(c) supply means for supplying said combustible gas;
(d) a preheating passageway within said spray head to promote warming of said combustible gas;
(e) exit bores defined by said frontal faces allowing the warmed combustible gas to pass from the frontal face of said spray head to said combustion space;
(f) supplying means for supplying said powder in a carrier gas;
(g) a passage to allow throughput of said powder in a carrier gas through said spray head;
(h) an exit orifice defined by said frontal face of said spray head allowing introduction of said powder in a carrier gas into said combustion space; and
(i) said side plates comprising comb-like teeth that, while confining the combustion space, absorb heat generated in said combustion space and transfer said heat to said spray head, forming a heat source for the warming of said combustible gas in said preheating passageway.

7. An apparatus as claimed in claim 6, wherein a cross-section of said perimeter parallel to said frontal face is not less in area than said frontal face.

8. An apparatus as claimed in claim 7, wherein said end plates and said side plates comprise a material displaying physical integrity at temperatures to be found in the combustion space and also displaying the property of high thermal conductivity.

9. An apparatus as claimed in claim 8, wherein said end plates and side plates are made of chrome steel.

10. An apparatus as claimed in claim 8, wherein said end and side plates have a thermally insulating layer on sides of said plates forming an exterior to said perimeter enclosing said combustion space.

11. An apparatus as claimed in claim 7, wherein said end plates and side plates are integral with said spray head.

12. An apparatus as claimed in claim 7, wherein said preheating passageway is of sufficient length to double said combustion gas residence time in said head when compared to the shortest possible passageway through said spray head.

13. An apparatus as claimed in claim 7, wherein said cross-section of said perimeter parallel to said frontal face is greater in area than said frontal face.

14. An apparatus as claimed in claim 7, wherein said exit orifice is an elongated slot.

15. An apparatus as claimed in claim 14, wherein said exit bores form two rows, one on each side of said exit orifice.

* * * * *